US010384831B2

(12) United States Patent
Vlahakis et al.

(10) Patent No.: US 10,384,831 B2
(45) Date of Patent: Aug. 20, 2019

(54) CONTAINER ASSEMBLY INCLUDING REMOVABLE SECONDARY CONTAINER

(71) Applicant: Venus Laboratories, Inc., Addison, IL (US)

(72) Inventors: Van Vlahakis, Cypress, CA (US); Kelly Vlahakis-Hanks, Cypress, CA (US); Jenna Arkin, New York, NY (US); Aaron Miller, Tacoma, WA (US); Liz Barrett, Newburgh, IN (US); Jason Rowe, Santa Claus, IN (US); Scott Fisher, Evansville, IN (US)

(73) Assignee: Venus Laboratories, Inc., Addison, IL (US)

( * ) Notice: Subject to any disclaimer, the term of this patent is extended or adjusted under 35 U.S.C. 154(b) by 0 days.

(21) Appl. No.: 15/677,769

(22) Filed: Aug. 15, 2017

(65) Prior Publication Data

US 2018/0050838 A1 Feb. 22, 2018

Related U.S. Application Data

(63) Continuation-in-part of application No. 29/575,114, filed on Aug. 22, 2016, now Pat. No. Des. 829,568, (Continued)

(51) Int. Cl.
*B65D 21/02* (2006.01)
*B65D 1/02* (2006.01)

(52) U.S. Cl.
CPC ..... *B65D 21/0204* (2013.01); *B65D 1/0246* (2013.01); *B65D 21/0237* (2013.01)

(58) Field of Classification Search
CPC ..... B65D 21/00–0237; B65D 1/0246
(Continued)

(56) References Cited

U.S. PATENT DOCUMENTS 251,566 A * 12/1881 Fuller ..... B65D 1/04 215/6
3,194,426 A * 7/1965 Brown, Jr. ..... B65D 21/0204 220/23.4

(Continued)

FOREIGN PATENT DOCUMENTS

GB 1260815 A 1/1972

OTHER PUBLICATIONS

Extended European search report dated Jan. 3, 2019 in corresponding EP Appl. No. 18189114.4.

*Primary Examiner* — Kareen K Thomas
(74) *Attorney, Agent, or Firm* — Drinker Biddle & Reath LLP

(57) ABSTRACT

A container assembly including a primary container and a secondary container removably attached to the primary container. The primary container includes a top, a bottom and a side. The side includes a recess in which the secondary container is located when attached to the primary container. The recess is defined by two side walls extending laterally from a rear wall of the recess toward an outer surface of the side wall. The secondary container includes a top, a bottom and a side. The secondary container is attached to the primary container through a set of securing attachments, each including a protrusion and mating indentation. At least one of the walls of the primary container and the side of the secondary container includes the set of protrusions, and the other of the walls of the primary container and the side of the secondary container includes the set of mating indentations.

12 Claims, 7 Drawing Sheets

Related U.S. Application Data and a continuation-in-part of application No. 29/575,112, filed on Aug. 22, 2016.

(58) Field of Classification Search
USPC ..... 220/23.2–23.8
See application file for complete search history.

(56) References Cited

U.S. PATENT DOCUMENTS

| | | | | | |
|---|---|---|---|---|---|
| 3,225,951 | A | | 12/1965 | Poston et al. | |
| 4,165,812 | A | * | 8/1979 | Jennison | B65D 21/0204 215/10 |
| 4,381,841 | A | | 5/1983 | Schwarz | |
| 5,065,875 | A | * | 11/1991 | Balavich | B65D 21/0237 206/504 |
| 5,123,460 | A | | 6/1992 | Reed | |
| 5,316,159 | A | * | 5/1994 | Douglas | B65D 21/0204 206/432 |
| 5,823,391 | A | * | 10/1998 | Klauke | B65D 35/22 222/94 |
| D464,570 | S | | 10/2002 | Maser et al. | |
| D495,949 | S | | 9/2004 | Rymer et al. | |
| 6,857,530 | B2 | * | 2/2005 | Yourist | B65D 21/0202 215/10 |
| D506,933 | S | | 7/2005 | Kearney | |
| D543,121 | S | | 5/2007 | Grant | |
| D607,753 | S | | 1/2010 | Farrell et al. | |
| D649,057 | S | | 11/2011 | Renz et al. | |
| D675,530 | S | | 2/2013 | Meisenheimer et al. | |
| D693,697 | S | | 11/2013 | Revivo | |
| D730,190 | S | | 5/2015 | Lindsay et al. | |
| D785,456 | S | | 5/2017 | Clemence et al. | |
| 2008/0073375 | A1 | | 3/2008 | Nelson et al. | |

* cited by examiner

CONTAINER ASSEMBLY INCLUDING REMOVABLE SECONDARY CONTAINER

RELATES APPLICATIONS

This application is related to can claims priority from U.S. design patent application 29/575,112 and 29/575,114, each filed on Aug. 22, 2016, the disclosures of which are each incorporated herein by reference in their entireties.

FIELD OF THE INVENTION

The present invention relates to containers for products, including consumer and industrial liquid products, and more particularly to a container assembly that includes a primary container onto which a secondary container is removably attached.

BACKGROUND

There are many situations in which it is beneficial, and in some cases necessary to have two materials used during an activity, where one of the materials is needed in less volume than the other. Some examples of such situations are: a fabric softener with a laundry detergent, a primer with a paint, a thinning agent with a concentrated chemical, a solidifier with an epoxy resin. In each of these cases, two containers are needed to store and carry the two combinable substances.

While separate containers are a fine method for storing the materials, the use of two containers has downside. For example it typically necessitates that the two products are somehow associated with one another so that the purchaser correctly buys the two proper components. It also requires additional shelf space in stores, which is becoming more and more difficult with the proliferation of various products for sale. There is also the problem that the products can become separated (either in the store or on the consumer's storage shelf) thus leading to wasted time searching for the product. Furthermore, manufacturers also risk loss of sales of one of the products if the consumer does not purchase the complimentary products together.

The primary solution to this issue has been to secure the secondary container to the primary container, such as packaging the two containers together (e.g., co-packaging the containers or shrink-wrapping the containers together), attaching the secondary container to the neck or handle of the primary container, such as with a plastic tie or ring, or adhering the secondary container to the side of the primary container. While these solutions address many of the problems associated with keeping two containers together during display in a store, they do not address the problem of keeping the containers together after purchase.

A need therefore exists for an improved container assembly for attaching two containers together where one is removably reattachable to the other.

SUMMARY OF THE INVENTION

The present invention relates to a container assembly which includes a primary container and a secondary container removably attached to the primary container. The primary container includes a top, a bottom and a side. The side includes a recess in which the secondary container is located when attached to the primary container. The recess is defined by two side walls extending laterally from a rear wall of the recess toward an outer surface of the side wall. The secondary container includes a top, a bottom and a side.

The secondary container is attached to the primary container through a set of securing attachments, each including a protrusion and mating indentation. At least one of the walls of the primary container and the side of the secondary container includes the set of protrusions, and the other of the walls of the primary container and the side of the secondary container includes the set of mating indentations.

The openings in the primary container and secondary container are each located in either the top, side or bottom of the respective container.

In one embodiment the walls of the recess in the primary container each include a protrusion which extends into the recess and toward one another, and the side of the secondary container includes the set of indentations located on opposite surfaces of the side and projecting into the container side toward one another. The indentations extend along a portion of the secondary container side substantially to the bottom of the secondary container.

In another embodiment the walls of the recess in the primary container include the indentation with each wall having one indentation that projects away from the secondary container, and the side of the secondary container includes the protrusions located on opposite surfaces of the side and projecting outward from the container side toward the indentations. The indentations extend along a portion of the primary container side substantially to the top of the primary container.

The walls are preferably spaced apart from one another such that the walls are closest wherein the protrusion is located and are further apart furthest from the protrusion.

In one embodiment, the bottom and a portion of the side of the primary container extend below the bottom of the secondary container so as to form a ledge on which the bottom of the secondary container sits.

The primary container may include an upper protrusion formed on the rear of the recess and positioned at a height at or above the top of the secondary container, the upper protrusion inhibiting the secondary container from sliding vertically upward.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

The above and other aspects, features, and advantages of the present invention may be more apparent from the following more particular description of embodiments thereof, presented in conjunction with the following drawings.

DETAILED DESCRIPTION OF THE PREFERRED EMBODIMENTS

A better understanding of various features and advantages of the present methods and devices may be obtained by reference to the following detailed description of illustrative embodiments of the invention and accompanying drawings. Although these drawings depict embodiments of the contemplated methods and devices, they should not be construed as foreclosing alternative or equivalent embodiments apparent to those of ordinary skill in the subject art.

Figure 3:
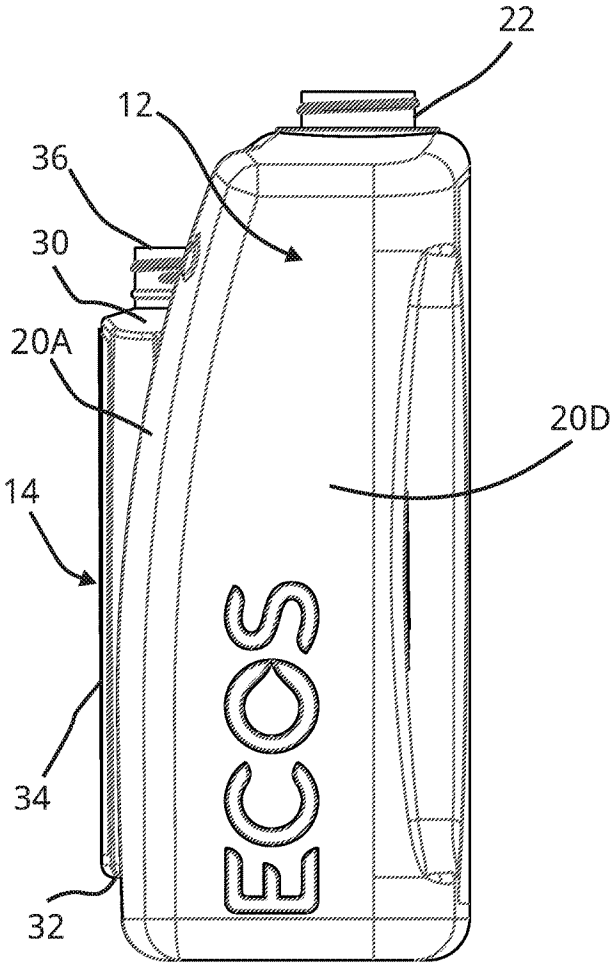
FIG. 3 is a right side view of the container assembly of FIG. 1.
Figure 1:
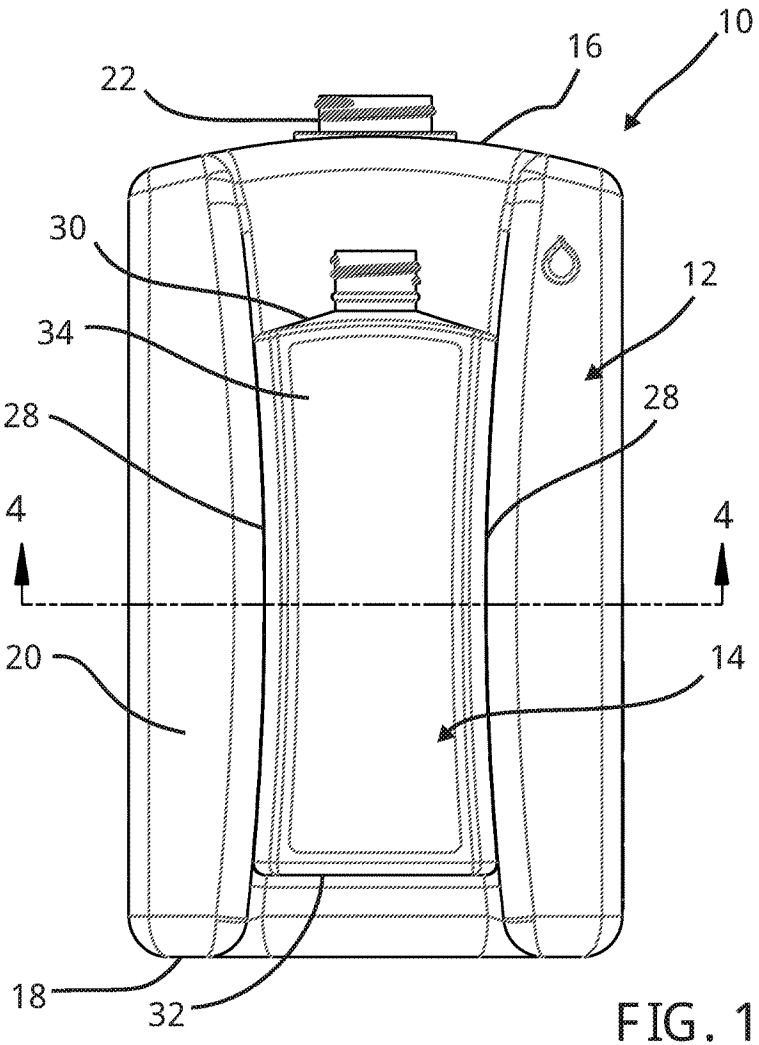
FIG. 1 is a front view of a container assembly with a secondary container removably attached to a primary container according to the present invention.
Figure 2:
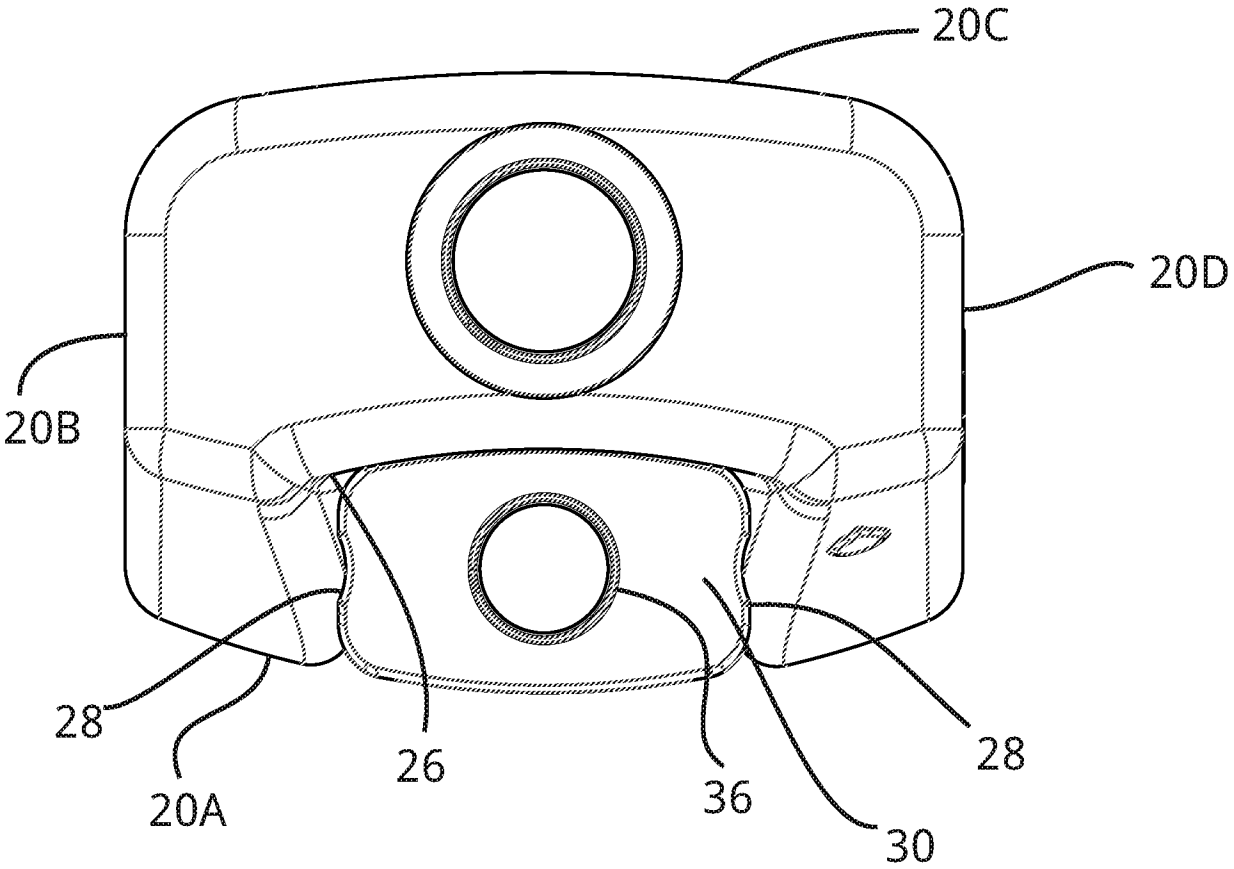
FIG. 2 is a top view of the container assembly of FIG. 1.

Referring to the drawings, and initially to FIG. 1, one preferred embodiment of a container assembly 10 according to the present invention is shown. A bottle is shown in the illustrated embodiment however, as will become apparent, the invention is applicable to a wide variety of containers. Also, it is contemplated to that the containers are preferably made from plastic material, although various other materials can be used. The container assembly 10 includes a primary or first container 12 and a secondary container 14. The secondary container 14 is removably attached to the primary container 12 as will be discussed in more detail below.

The primary container 12 includes a top 16, a bottom 18 and a side 20. The top preferably includes an opening for dispensing the products located in the container. The opening could alternately be located on the side 20 or bottom 18. In the illustrated embodiment, the top includes a neck 22 which circumscribes the opening and a cap (not shown) is removably attached to the neck 22 for closing the opening in a conventional manner.

The container side 20 in the illustrated embodiment is semi-rectangular in shape so as to have four side portions 20A, 20B, 20C and 20D. Of course, the side 20 could be cylindrical or any other shape thus changing the number of side portions. The side 20 includes at least one recess 26 in which the secondary container 14 is located when attached to the primary container. The recess is defined by two walls 28 extending laterally from the rear of the recess 26 to the outer surface of the side wall 20. The lateral walls 28 interact with the secondary container 14 for securing the secondary container 14 to the primary container 12. In the illustrated embodiment, the recess 26 is formed in the side portion $\mathbf{20}_A$, however it could be formed in any side portion. Also there could be two or more recesses 26 formed in the side 20, each having respective lateral projecting walls 28.

The secondary container 14 includes a top 30, a bottom 32 and a side 34. The top 30 preferably includes an opening for dispensing the products located in the secondary container 14. The opening could alternately be located on the side 34 or bottom 32. In the illustrated embodiment, the top 30 includes a neck 36 which circumscribes the opening and a conventional cap (not shown) that is removably attached to the neck 36 for closing the opening in a conventional manner.

Figure 7C:
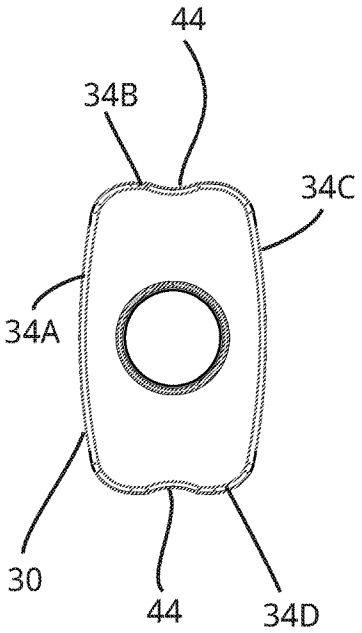
FIGS. 7A-7C illustrate a secondary container according to an embodiment of the invention for use in the container assembly of FIG. 1.
Figure 7B:
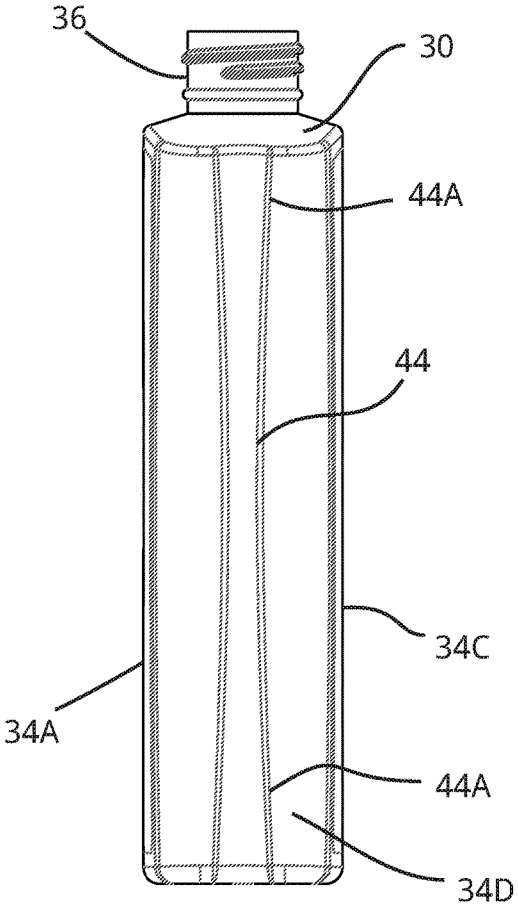
Figure 7A:
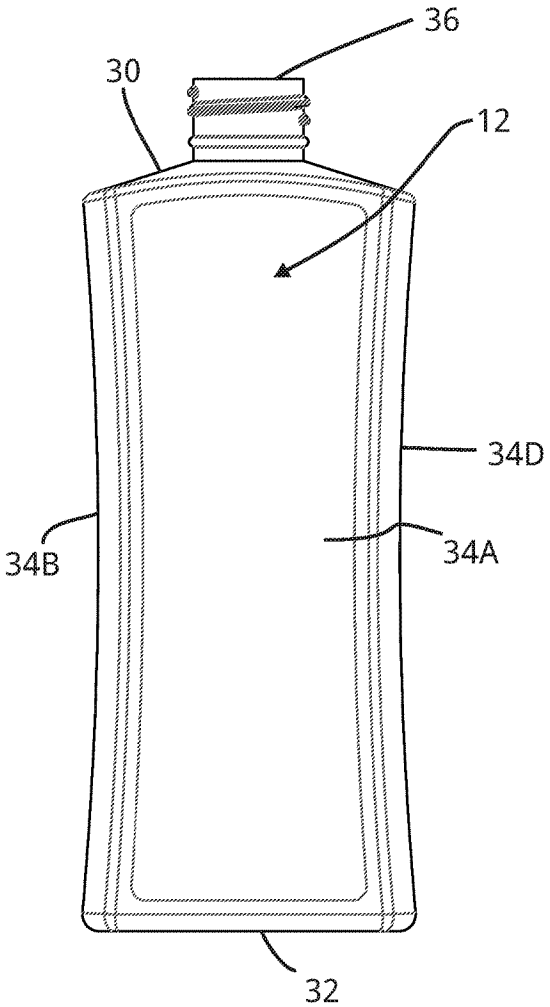

As with the primary container 12, the secondary container side 34 in the illustrated embodiment is semi-rectangular in shape, as shown in FIGS. 7A-7C, so as to have four side portions 34A, 34B, 34C and 34D. Of course, the side 34 could be cylindrical or any other shape thus changing the number of side portions. The secondary container 14 is sized to fit within the recess 36 in the primary container 12. The side 34 of the secondary container 14 interacts with the walls 28 as discussed below for removably securing the secondary container 14 to the primary container 12.

The attachment of the secondary container to 14 the primary container 12 is through a set of securing attachments 40, each securing attachment including a protrusion 42 and mating indentation 44. Referring to FIG. 4, which is a section through the primary and secondary container sides 20, 34, in the illustrated embodiment, the walls 28 of the primary container 12 include protrusions 42 that extend into the recess and toward one another. The protrusions 42 may be a single protrusion 42 on each of the walls 28 or may be multiple protrusions 42 on each wall spaced apart vertically from one another. The protrusions 44 can more clearly be seen with reference to FIGS. 8A and 8B which shown the primary container 12 without the secondary container 14 attached.

The secondary container 14 includes mating indentations 44 formed on opposite surfaces of the side 34 of the secondary container 14 (e.g., 34B and 34D). The indentations 44 project into the container side 34 toward one another and are configured to mate with the protrusions 42. An embodiment of the secondary container 14 illustrating the indentations is shown in FIGS. 7A-7C.

Figure 4A:
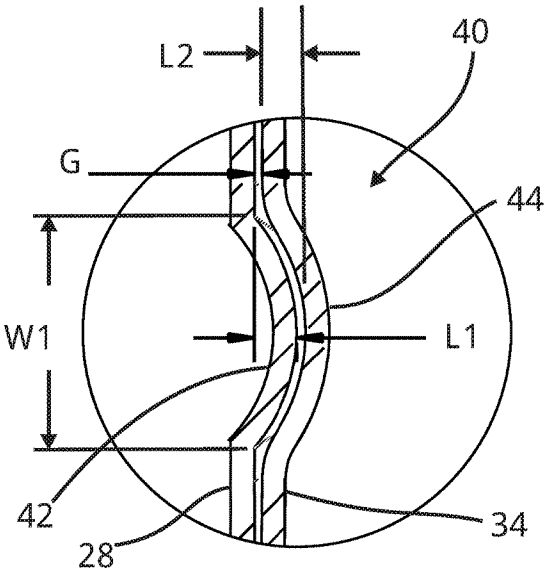
FIG. 4A is an enlarged view of a securing mechanism according to an embodiment of the invention.
Figure 4:
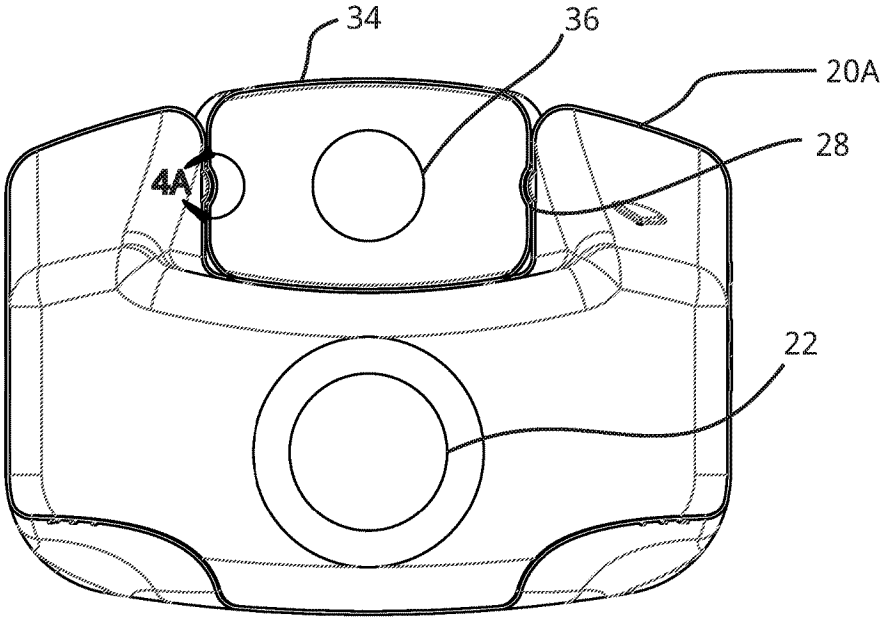
FIG. 4 is a section view of the container assembly of FIG. 1 taken along lines 4-4 in FIG. 1.
Figure 8B:
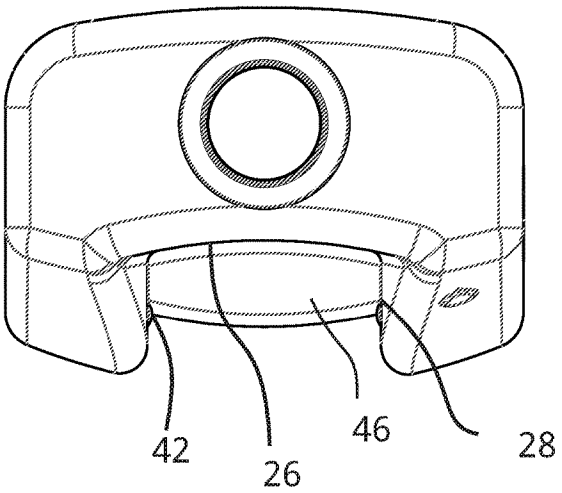
FIGS. 8A and 8B illustrate the primary container of FIG. 1 without the secondary container attached.
Figure 8A:
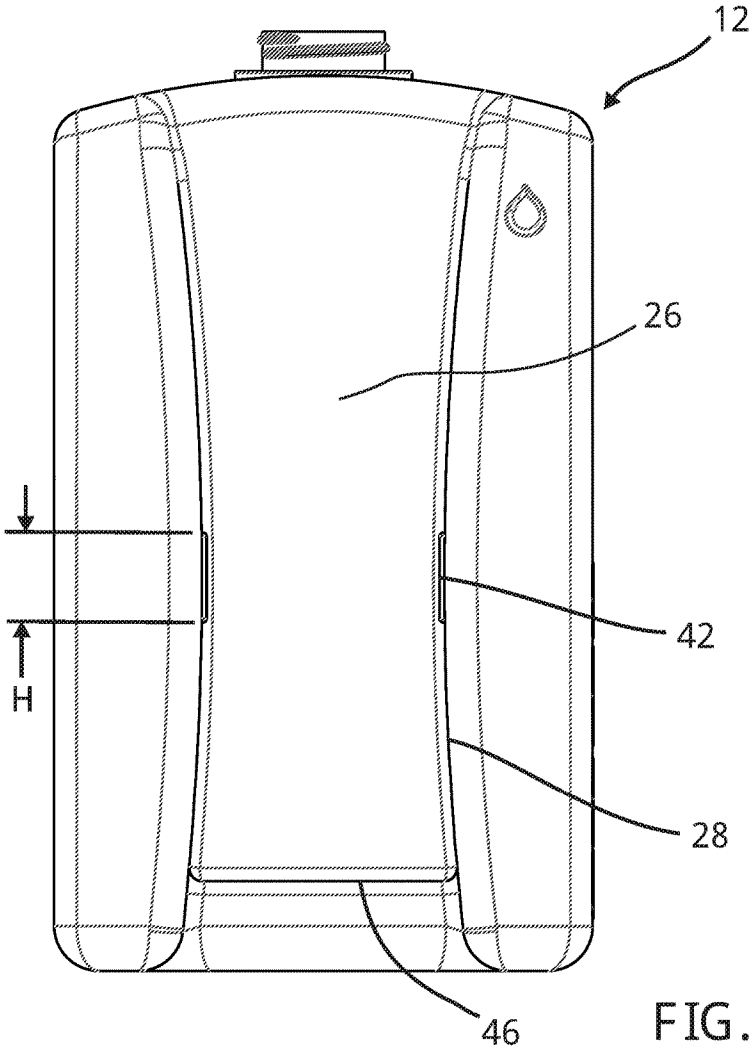

More particularly and with reference to FIG. 4A, which is an enlargement of one securing mechanism 40, the wall of the primary container 12 includes a bulbous protrusion 42 which seats within a mating indentation 44 on the secondary container 14. The protrusion 42 projects a distance L1 toward the side 34 of the secondary container 14, and has a width dimension W1. As shown in FIGS. 8A and 8B, the protrusion 42 has a height of H. In one preferred embodiment, the height H is approximately 1.0 inches. however it should be apparent that other heights H can be used depending on the size of the secondary container. The indentation 44 projects a distance L2 toward the center of the secondary container 14 and has a width dimension W2. In order to make the secondary container 14 easily removable from the primary container 12, the indentations 44 preferably extend along a portion of the container side 34 toward the bottom 32. As shown in FIG. 7B, the indentations 44 preferably extend from the location where they mate with the protrusions 42 to the bottom 32. The indentations 44 may taper apart as shown by the numeral 44A.

Since the secondary container 14 will contain material, such as liquid, during use, it is important that the securing mechanisms 40 sufficiently secure the secondary container 14 to the primary container 12. To accomplish this, in one embodiment, the protrusion has an L1 dimension of approximately 0.054 inches and a width dimension W1 of approximately 0.29 inches. The indentation 44 has an L2 dimension of approximately 0.054 inches, and a width dimension W2 of approximately 0.30 inches. There is preferably a gap G formed between the mating surfaces of the protrusion 42 and indention 44. In one embodiment, the gap is approximately 0.010 inches. Of course it should be readily apparent that the protrusions 42 and indentations 44 could be reversed, i.e., with the indentations located on the walls 28 of the primary container 12 and the protrusions 44 located on the sides of the secondary container 14. In certain embodiments, the secondary container 12 is configured to be removably secured to the primary container so that it can be slid upward and out of engagement with securing mechanisms 40. In another embodiment, the secondary container is removed by pulling the bottle laterally away from the primary container. In the embodiment shown in FIG. 1, the side portions $\mathbf{20}_A$ of the primary container preferably bow laterally inward toward the recess 26 from either side to restrict the secondary bottle from moving up and down or side to side within the recess 26. As should be apparent, the use of the protrusion/indentation, would work in combination with the bowed sidewall to retain the secondary container.

Preferably the securing mechanisms 40 are positioned approximately at the middle of the vertical height of the secondary container 14 in one embodiment. Alternatively, the securing mechanisms 40 can be positioned along the lower portion of the vertical height of the secondary container 14 To facilitate disengagement, the walls 28 of the primary container 12 may taper away from the side 34 of the secondary container 14 as they extend upward from the middle of the secondary container 14 as shown in FIG. 1.

Figure 5:
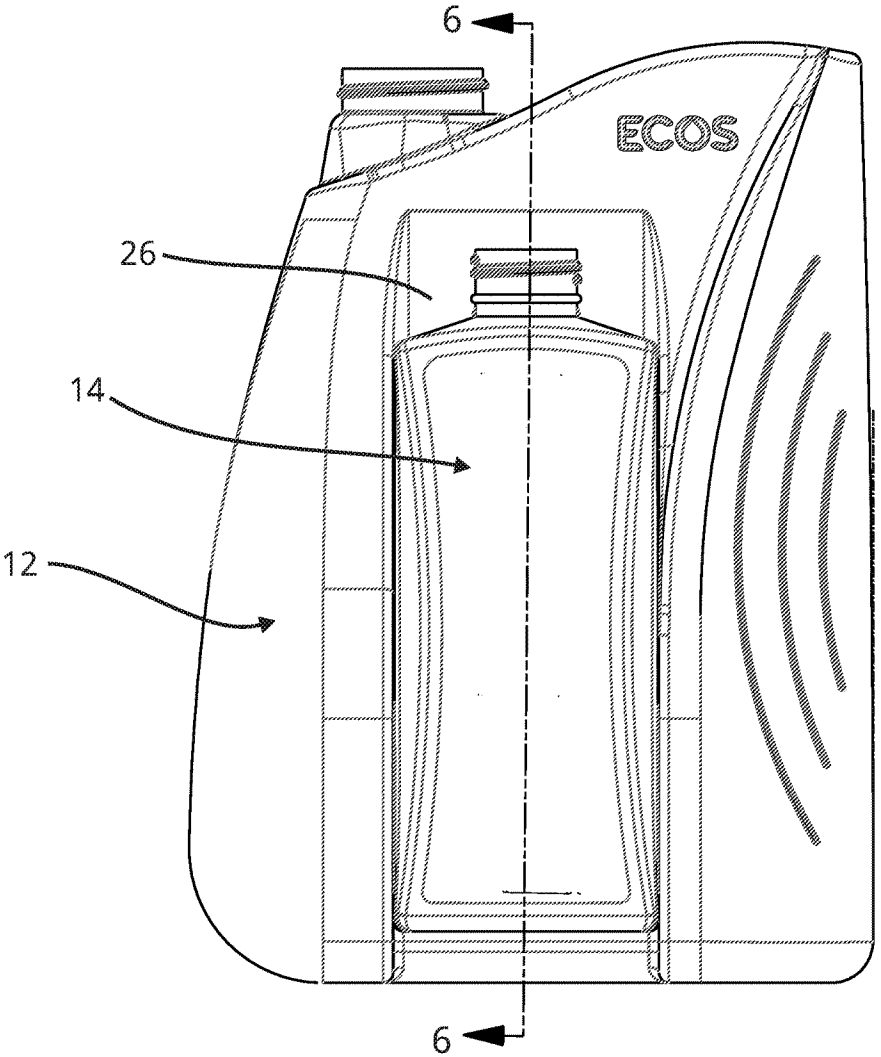
FIG. 5 is another embodiment of a container assembly according to the present invention.
Figure 6:
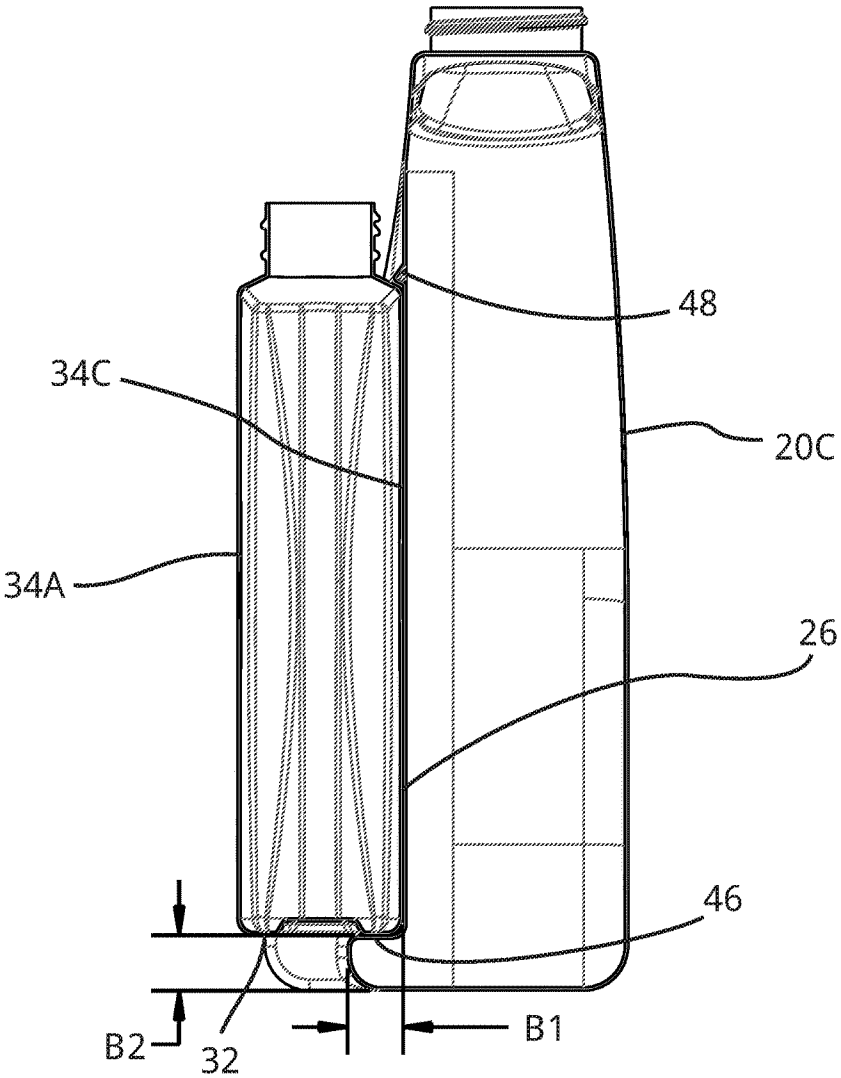
FIG. 6 is a section view of the container assembly of FIG. 5 taken along lines 6-6 in FIG. 5.

Referring to FIGS. 5 and 6, a second embodiment of the invention is shown. Many of the aspects of the first embodiment are applicable to the second embodiment. In this embodiment, the dimension L1 is approximately 0.055 inches, the dimension W1 is approximately 0.306 inches, the dimension L2 is approximately 0.055, and the dimension W2 is approximately 0.316 inches.

As shown in the second embodiment, to provide further securement for the secondary container 14 on the primary container, an upper protrusion 48 may be formed in the back of the recess 26 and positioned at a height at or slightly above the top 30 of the secondary container 14. The upper protrusion 48 inhibits the secondary container 14 from sliding vertically upward without a slight pulling. This protrusion could be added to the first embodiment if desired.

In order to provide extra support for the secondary container 14, the side 20 and bottom 18 of the primary container may extend below the bottom 32 of the secondary container to form a ledge on which the bottom 32 of the secondary container 14 rests. In the embodiment shown in FIG. 5, the ledge 46 is positioned at a distance B2 from the bottom 18 of the primary container and extends outward a distance B1 from the back of the recess 26. In this illustrated embodiment, the distance B1 is approximately 0.50 inches and the distance B2 is approximately 0.50 inches. This forms a sufficient size ledge 46 to support the secondary container 14.

As should be apparent, in order to separate the secondary container 14 from the primary container 12, the user need only slide the secondary container 14 upward, thus disengaging the securing mechanisms 40 (as shown above in the first embodiment) and the protrusion 48 (as shown above in the second embodiment). The secondary container 14 can be easily reattached to the primary container 12 by simply reversing the procedure.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those skilled in this art without departing from the spirit and scope of the invention.

The invention claimed is:

1. A container assembly comprising a primary container and a secondary container removably attached to the primary container;

the primary container includes a top, a bottom and a side, the primary container having opening for dispensing the contents located therein, the side includes at least one recess in which the secondary container is located when attached to the primary container, the recess is defined by two side walls extending laterally from a rear wall of the recess toward an outer surface of the side wall;

the secondary container includes a top, a bottom and a side, the secondary container has an opening for dispensing contents located therein; and wherein attachment of the secondary container to the primary container is through a set of securing attachments, each securing attachment including a protrusion and mating indentation, at least one of the walls of the primary container and the side of the secondary container includes the set of protrusions, and the other of the walls of the primary container and the side of the secondary container includes the set of mating indentations, each protrusion seats within a mating indentation when the secondary container is attached to the primary container;

wherein the walls are spaced apart from one another such that the walls are closest wherein the protrusion is located and are further apart furthest from the protrusion.

2. The container assembly of claim 1 wherein the openings in the primary container and secondary container are each located in either the top, side or bottom of the respective container.

3. A container assembly comprising:

a primary container and a secondary container removably attached to the primary container;

the primary container includes a top, a bottom and a side, the primary container having opening for dispensing the contents located therein, the side includes at least one recess in which the secondary container is located when attached to the primary container, the recess is defined by two side walls extending laterally from a rear wall of the recess toward an outer surface of the side wall;

the secondary container includes a top, a bottom and a side, the secondary container has an opening for dispensing contents located therein; and wherein attachment of the secondary container to the primary container is through a set of securing attachments, each securing attachment including a protrusion and mating indentation, at least one of the walls of the primary container and the side of the secondary container includes the set of protrusions, and the other of the walls of the primary container and the side of the secondary container includes the set of mating indentations, each protrusion seats within a mating indentation when the secondary container is attached to the primary container;

wherein the walls of the recess in the primary container each include a protrusion which extends into the recess and toward one another, and the side of the secondary container includes the set of indentations located on opposite surfaces of the side and projecting into the container side toward one another, the indentations extend along a portion of the secondary container side substantially to the bottom of the secondary container; and wherein a width dimension of each indentation increases as the indentation extends toward the bottom.

4. The container assembly of claim 1 wherein the walls of the recess in the primary container include the indentation with each wall having one indentation that projects away from the secondary container, and the side of the secondary container includes the protrusions located on opposite surfaces of the side and projecting outward from the container side toward the indentations, and wherein the indentations extend along a portion of the primary container side substantially to the top of the primary container.

5. The container assembly of claim 1 wherein the protrusion projects approximately 0.055 inches from the wall, and has a width of approximately 0.314 inches.

6. The container assembly of claim 1 wherein there is a gap of approximately 0.010 inches between the mating surfaces of the protrusion and indention.

7. The container assembly of claim 1 wherein the secondary container side is semi-rectangular in shape so as to have four side portions.

8. The container assembly of claim 1 wherein there are at least two recesses formed in the side of the primary container, each having respective lateral projecting walls and removably securing a secondary container.

9. The container assembly of claim 1 wherein there are multiple protrusions on each wall spaced apart vertically from one another.

10. The container assembly of claim 1 wherein the bottom and a portion of the side of the primary container extend below the bottom of the secondary container so as to form a ledge on which the bottom of the secondary container sits.

11. The container assembly of claim 10 wherein the ledge is positioned at a distance of approximately 0.50 inches from the bottom of the primary container and extends outward a distance of approximately 0.50 inches from the rear of the recess.

12. The A container assembly of claim 1 comprising:

a primary container and a secondary container removably attached to the primary container;

the primary container includes a top, a bottom and a side, the primary container having opening for dispensing the contents located therein, the side includes at least one recess in which the secondary container is located when attached to the primary container, the recess is defined by two side walls extending laterally from a rear wall of the recess toward an outer surface of the side wall;

the secondary container includes a top, a bottom and a side, the secondary container has an opening for dispensing contents located therein;

an upper protrusion formed on the rear of the recess and positioned at a height at or above the top of the secondary container, the upper protrusion inhibiting the secondary container from sliding vertically upward; and wherein attachment of the secondary container to the primary container is through a set of securing attachments, each securing attachment including a protrusion and mating indentation, at least one of the walls of the primary container and the side of the secondary container includes the set of protrusions, and the other of the walls of the primary container and the side of the secondary container includes the set of mating indentations, each protrusion seats within a mating indentation when the secondary container is attached to the primary container.

* * * * *